US010106953B2

(12) United States Patent
Knol

(10) Patent No.: US 10,106,953 B2
(45) Date of Patent: Oct. 23, 2018

(54) DRIVE SYSTEM FOR A SPUD CARRIER

(71) Applicant: IHC Holland IE B.V., Sliedrecht (NL)

(72) Inventor: Albertus Knol, Numansdorp (NL)

(73) Assignee: IHC Holland IE B.V., Sliedrecht (NL)

( * ) Notice: Subject to any disclaimer, the term of this patent is extended or adjusted under 35 U.S.C. 154(b) by 0 days.

(21) Appl. No.: 15/552,306

(22) PCT Filed: Mar. 1, 2016

(86) PCT No.: PCT/NL2016/050143
§ 371 (c)(1),
(2) Date: Aug. 21, 2017

(87) PCT Pub. No.: WO2016/140571
PCT Pub. Date: Sep. 9, 2016

(65) Prior Publication Data

US 2018/0044882 A1 Feb. 15, 2018

(30) Foreign Application Priority Data

Mar. 2, 2015 (NL) ..... 2014376

(51) Int. Cl.
*E02F 9/06* (2006.01)
*B63H 19/08* (2006.01)

(52) U.S. Cl.
CPC ..... *E02F 9/062* (2013.01); *B63H 19/08* (2013.01); *E02F 9/067* (2013.01)

(58) Field of Classification Search
CPC ..... E02F 9/062; E02F 9/065; E02F 9/067; B63H 19/08
See application file for complete search history.

(56) References Cited

U.S. PATENT DOCUMENTS 890,470 A * 6/1908 Taft et al. ..... B41J 2/325 346/111
3,656,449 A * 4/1972 Mead ..... E02F 9/062 37/346

(Continued)

FOREIGN PATENT DOCUMENTS

JP 62-12659 1/1987
JP 62-44957 3/1987

(Continued)

OTHER PUBLICATIONS

Search report/written opinion of PCT/NL2016/050143 dated Jun. 29, 2016, see p. 4 for the relevant documents, pp. 10-11 for the "Reasoned statement with regard to novelty, inventive step or industrial applicability".

*Primary Examiner* — Jamie L McGowan
(74) *Attorney, Agent, or Firm* — Lindsey A. Auerbach; Catherine A. Shultz; N.V. Nederlandsch Octrooibureau

(57) ABSTRACT

A spud system for a dredging vessel with a longitudinal direction includes a spud carrier for mounting a spud therein in a vertical stance and which spud carrier is moveable with respect to the dredging vessel in a longitudinal direction for advancing the dredging vessel, a spud carrier drive system coupled with the dredging vessel and the spud carrier for driving the spud carrier with respect to the dredging vessel. The spud carrier drive system includes a hydraulic drive cylinder for controlling the position of the spud carrier. The spud system further comprises a hydraulic system comprising a parallel hydraulic cylinder in fluid parallel connection with the hydraulic drive cylinder and presstressing means coupled with a rod of the parallel hydraulic cylinder such that said rod is forced towards a central position.

16 Claims, 4 Drawing Sheets

(56) References Cited

U.S. PATENT DOCUMENTS

| | | | | | |
|---|---|---|---|---|---|
| 4,033,056 | A * | 7/1977 | Demmers | E02F 9/062 | 37/309 |
| 4,342,164 | A * | 8/1982 | Claassen | E02F 3/907 | 37/309 |
| 4,432,420 | A * | 2/1984 | Gregory | E21B 19/09 | 166/355 |
| 7,900,381 | B2 * | 3/2011 | Clynnans | F28F 1/325 | 114/295 |
| 2009/0126237 | A1 * | 5/2009 | Clynnans | E02F 9/062 | 37/317 |
| 2015/0345107 | A1 * | 12/2015 | Zwanenburg | E02F 3/9231 | 37/309 |
| 2017/0089037 | A1 * | 3/2017 | Knol | E02F 9/062 | |

FOREIGN PATENT DOCUMENTS

| | | | | |
|---|---|---|---|---|
| JP | 62-81654 | | 5/1987 | |
| JP | 01226939 | A * | 9/1989 | E02F 3/8841 |
| WO | WO-2013157944 | A1 * | 10/2013 | E02F 3/8841 |

* cited by examiner

DRIVE SYSTEM FOR A SPUD CARRIER

BACKGROUND

The present invention relates to a spud system for a dredging vessel with a longitudinal direction, which spud system comprises a spud carrier for mounting a spud therein in a vertical stance and which spud carrier is moveable with respect to the dredging vessel in a longitudinal direction for advancing the dredging vessel.

In general a cutter suction dredger is fitted with a spud carrier that allows the dredger to be pushed forward when the working spud mounted in the spud carrier has penetrated into the bottom.

In circumstances where large external forces are exerted on the dredger due to sea currents, waves, swell or other causes, overloading of the spud and/or the spud carrier cylinder which drives the spud carrier, is prevented by allowing the spud to move and thus give way to the overload.

However in view of production capacity of the cutter suction dredger, it is important that the neutral position of the spud carrier is a) well defined and that, b) after removal of the overload condition, the spud carrier quickly returns to that neutral position.

The neutral position refers to the carrier and the spud wherein the spud takes a vertical stance.

It is known for spud carriers that are held in a vertical position by means of a wire system, that the overload protection can be realized by allowing at least one of the sheaves to move. As a result the spud carrier will rotate and give way to the overload. Simply connecting a gas spring (accumulator) to this wire system prevents overloading to occur but has as a consequence that there is no well-defined fixed position of the spud before and after overload. Such a spud carrier system is known from WO2006130934 wherein an apparatus is disclosed for accommodating a substantially vertical spud of a dredging vessel with a longitudinal direction, comprising a spud carriage which is mounted for limited rotation around a horizontal transverse axis, wherein at least a first and a second spring means is arranged under bias between the vessel and spud in the longitudinal direction for the purpose of absorbing a moment on the spud carriage, which first and second spring means compensate each other in the non-loaded situation of the spud; and—at least one spring means is provided with a spring force limiting means for limiting the tension in said spring element from a determined maximum moment on the spud carriage.

For spud carriers that do not allow the spud to rotate, it is known to allow the cylinder to yield by releasing oil out of the cylinder to give way to the overload. In that case however, resuming the originally required position is either slow or it requires a lot of pump sets, sensors and power. Such a system is described in the March 2006 issue of "Offshore engineer" in an article titled "Sophisticated controller keeps giant dredger on course" which discusses the hydraulic system for the spud carrier positioning system of a giant cutter suction dredger.

SUMMARY OF THE INVENTION

The invention aims to provide a more efficient and simple overload control for a spud system for a dredging vessel in that e.g. less pump power is required.

Another object of the invention is to improve a known spud system for a dredging vessel in that a problem associated therewith is at least partly solved.

Yet another object of the invention is to provide a spud system wherein the overload is controlled in an alternative way.

According to a first aspect of the invention this is realized with a spud system for a dredging vessel with a longitudinal direction, which spud system comprises:

- a spud carrier for mounting a spud therein in a vertical stance and which spud carrier is moveable with respect to the dredging vessel in a longitudinal direction for advancing the dredging vessel,
- a spud carrier drive system coupled with the dredging vessel and the spud carrier for driving the spud carrier with respect to the dredging vessel, wherein the spud carrier drive system comprises a hydraulic drive cylinder for controlling the position of the spud carrier,
- a hydraulic system comprising a parallel hydraulic cylinder in fluid parallel connection with the hydraulic drive cylinder, and presstressing means coupled with a rod of the parallel hydraulic cylinder such that said rod is forced towards a central position.

The parallel hydraulic cylinder in fluid parallel connection with the hydraulic drive cylinder provides the possibility to allow the spud to give way when an overload occurs. In case of an overload on the spud, pressurized oil flows from the hydraulic drive cylinder to the parallel hydraulic cylinder in a controlled manner without depressurizing the oil to atmospheric pressure.

The presstressing means coupled with the rod of the parallel hydraulic cylinder and the parallel hydraulic cylinder in fluid parallel connection with the hydraulic drive cylinder allow the hydraulic drive cylinder to resume its original required position very quickly while no additional pump capacity is needed.

Any suitable prestressing means is conceivable.

The invention is in particular beneficial for spud systems wherein the spud is not able to rotate with respect to the spud carrier or the sea floor(for example, when the spud is so deep in the sea floor it cannot rotate).

The parallel hydraulic cylinder in fluid parallel connection with the hydraulic drive cylinder means that the respective rods of these cylinders are not coupled, instead corresponding pressure chambers are in fluid connection.

In an embodiment of the spud system, the prestressing means comprise a self centering cylinder which makes control of the position of the spud carriage even more simple. In addition, such a self centering cylinder enables to easily set a threshold force above which the spud gives way.

In an embodiment of the spud system, the rod of the hydraulic parallel cylinder is coupled with a rod of the self centering cylinder. This enables to provide an integrated solution for the hydraulic parallel cylinder and the self centering cylinder.

In an embodiment of the spud system, the rod of the hydraulic parallel cylinder and the rod of the self centering cylinder are of one-piece and form a common rod of the hydraulic parallel cylinder and the self centering cylinder. This actually provides an integrated solution for the hydraulic parallel cylinder and the self centering cylinder.

In an embodiment, the spud system comprises a control cylinder, wherein a rod of the control cylinder is coupled with the common rod for providing auxiliary control of the position of the common rod. This provides an even more and accurate control of the force on the spud.

In an embodiment of the spud system, the hydraulic drive cylinder and parallel hydraulic cylinder have a similar configuration with respect to bore and rod diameter for facilitating position control of the spud carrier.

In an embodiment, the spud system comprises an accumulator system coupled with the self centering cylinder for providing a desired centering force and a desired spring action for the rod of the self centering cylinder.

In an embodiment of the spud system, the self centering cylinder comprises a pair of opposite pressurized fluid chambers, the rod of the self centering cylinder is provided with a central flange arranged such that the opposite pressurized fluid chambers exert the centering force on the rod of the self centering cylinder.

In an embodiment of the spud system, the pair of opposite pressurized fluid chambers are in fluid connection with the accumulator system.

In an embodiment of the spud system, the accumulator system comprises a common source of pressure and the pair of opposite pressurized fluid chambers are in fluid connection with the common source of pressure.

In an embodiment of the spud system, the accumulator system comprises a number of respective sources of pressure, and pressurized fluid chambers are each in fluid connection with a respective source of pressure.

In an embodiment of the spud system, the accumulator system comprises an accumulator with an adjustable gas pressure in order to be able to adjust the centering force.

In an embodiment of the spud system, the rod of the self centering cylinder is provided with a free piston and the centering force is exerted through said free piston. This facilitates to set the centering force and a desired spring action more independently.

In an embodiment of the spud system, the rod of the self centering cylinder is provided with a pair of opposite free pistons arranged at opposite sides of the central flange and the centering force is exerted through said pair of pistons. This facilitates to set the centering force and a desired spring action more independently and also to make a different setting for the bow and stern side of the spud.

In an embodiment of the spud system, a self centering cylinder housing is provided with a stop for defining the central position of the common rod. This facilitates in defining the central position.

The invention further relates to a dredger comprising the spud system according to the invention.

The invention further relates to a device comprising one or more of the characterising features described in the description and/or shown in the attached drawings.

The invention further relates to a method comprising one or more of the characterising features described in the description and/or shown in the attached drawings.

The various aspects discussed in this patent can be combined in order to provide additional advantageous advantages.

DESCRIPTION OF THE DRAWINGS

The invention will be further elucidated referring to the following schematic drawings wherein shown in.

DETAILED DESCRIPTION OF EMBODIMENTS

Figure 1:
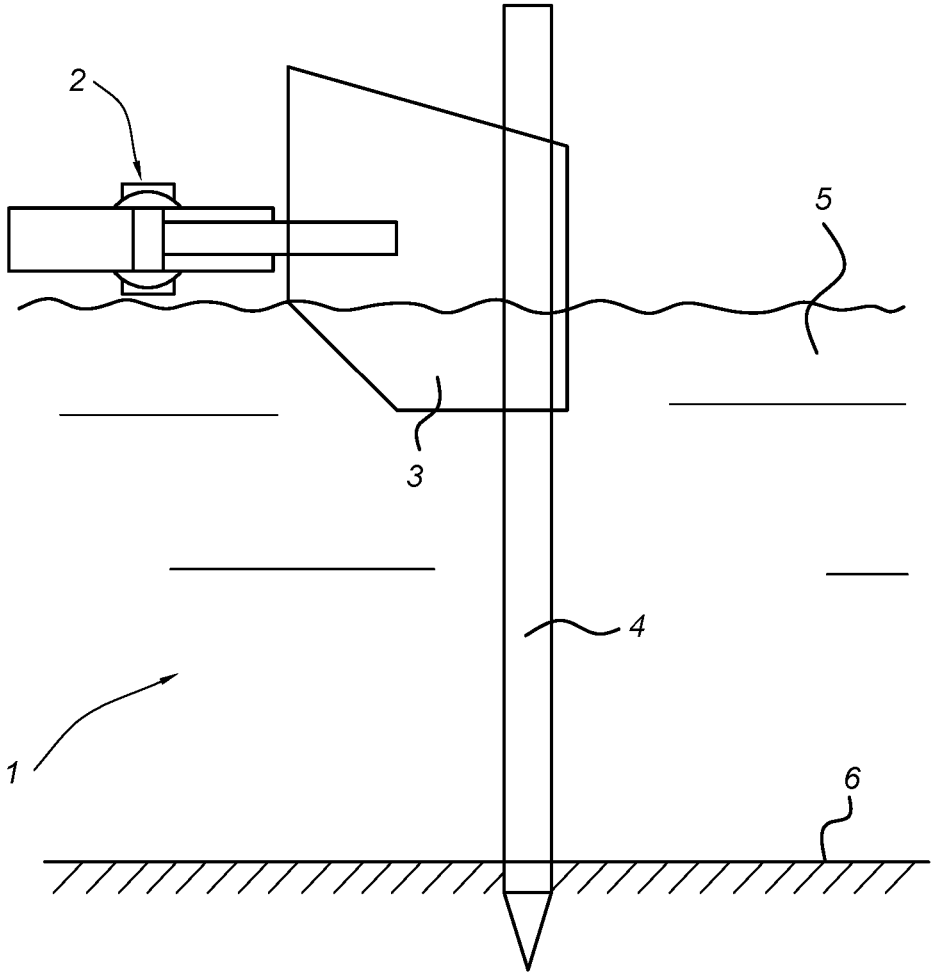
FIG. 1 is a side view of a spud system for a dredging vessel.

FIG. 1 shows in side view a spud system 1 for a dredging vessel (not shown). Such a spud system engages the bottom 6 of a body of water 5, like a river. The spud system 1 engages the bottom through a number of spuds 4. In general one of these spuds 4 is driveable and in FIG. 1 only the drivable spud 4 is shown. The driveable spud 4 is mounted in a spud carrier 3 also referred to with spud carriage. The spud 4 is mounted with the spud carrier 3 in a vertical stance. A spud carrier drive system, in the form of a hydraulic drive cylinder 2, for controlling the position of the spud carrier 3 is coupled with the dredging vessel and the spud carrier 3 for driving the spud carrier with respect to the dredging vessel. The assembly of the spud carrier 3 and spud 4 is coupled with the hydraulic drive cylinder 2 spud carrier cylinder 2 for driving the spud 4 with respect to the vessel. The hydraulic drive cylinder 2 is also referred to with spud carrier cylinder 2. The spud 4 is driven by the spud carrier cylinder 2 and is moveable in a longitudinal direction of the vessel for stepwise advancing the vessel.

Figure 2A:
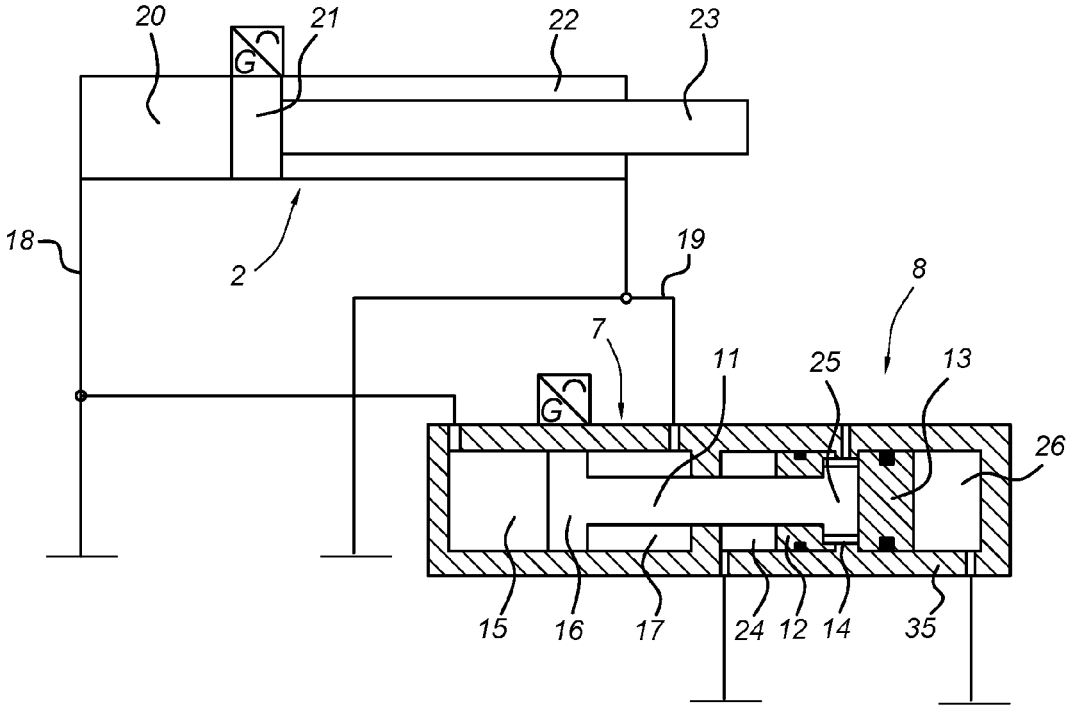
FIG. 2*a* is a hydraulic scheme for operating the drive cylinder of a spud system according to the invention.

FIG. 2*a* shows an hydraulic scheme of a hydraulic system for operating the drive cylinder, that is the spud carrier cylinder 2, of a spud system 1. The hydraulic drive cylinder 2 has a piston 21 and fluid chambers 20, 22 on both sides of the piston 21, and a piston rod 23 firmly coupled with the piston 21.

The spud system comprises a hydraulic system comprising a parallel hydraulic cylinder 7 in fluid parallel connection with the hydraulic drive cylinder 2. The parallel hydraulic cylinder 7 has a piston 16 and fluid chambers 15, 17 on both sides of the piston 16 and a piston rod 11 firmly coupled with the piston 16. The fluid parallel connection means that fluid lines 18, 19 are in fluid connection with corresponding fluid chambers 20, 22, 15, 17 of the spud carrier cylinder 2 and the parallel hydraulic cylinder 7 such that a parallel circuit is formed. The fluid lines 18, 19 are in fluid connection with a source of pressurized fluid known per se, which source is suitable to drive the spud carrier cylinder 2.

The hydraulic system of the spud system 1 comprises presstressing means referred to with 8. The prestressing means 8 is coupled with the rod 11 of the parallel hydraulic cylinder 7 such that said rod 11 is forced towards a central position as shown in FIGS. 2*a*-2*d*. In this case, the presstressing means comprise a self centering cylinder 8, which is known per se. The self centering cylinder 8 has a flange 25 and fluid chambers 24, 26 on both sides of the flange 25 and a piston rod.

The rod 11 of the hydraulic parallel cylinder 7 is firmly coupled with the rod of the self centering cylinder 8. In this case, the rod 11 of the hydraulic parallel cylinder 7 and the rod of the self centering cylinder 8 are of one-piece and form a common rod of the hydraulic parallel cylinder and the self centering cylinder.

The hydraulic drive cylinder 2 and parallel hydraulic cylinder 7 have a similar configuration with respect to bore and rod diameter for facilitating position control of the spud carrier 3.

As described, the self centering cylinder 8 comprises a pair of opposite pressurized fluid chambers 24, 26. Here, the rod of the self centering cylinder 8 is provided with a central flange 25 arranged such that the opposite, pressurized, fluid chambers exert the centering force on the rod of the self centering cylinder through the central flange.

The rod of the self centering cylinder 8 is provided with a free piston 12, 13 and the centering force is exerted through said free piston 12, 13. Such a free piston 12, 13 abuts the central flange 25. In this case, the rod of the self centering cylinder 8 is provided with a pair of opposite free pistons 12, 13 arranged at opposite sides of the central flange 25 and the centering force is exerted through said pair of pistons. The self centering cylinder housing 35 is provided with a stop 14 for defining the central position of the common rod 11.

The hydraulic system of the spud system 1 comprises an accumulator system (not shown) which is known per se. The accumulator system is coupled with the self centering cylinder 8 for providing a desired centering force and a desired spring action for the rod of the self centering cylinder. As an example, such a known accumulator system may comprise an accumulator with an adjustable gas pressure in order to be able to adjust the centering force. The pair of opposite pressurized fluid chambers 24, 26 of the centering cylinder 8 are in fluid connection with the accumulator system. Preferably, a desired centering force and a desired spring action can be set individually for each of the pressurized fluid chambers 24, 26. Therefore, the accumulator system comprises a number of respective sources of pressure and the pressurized fluid chambers 24, 26 are each in fluid connection with a respective source of pressure.

Figure 3A:
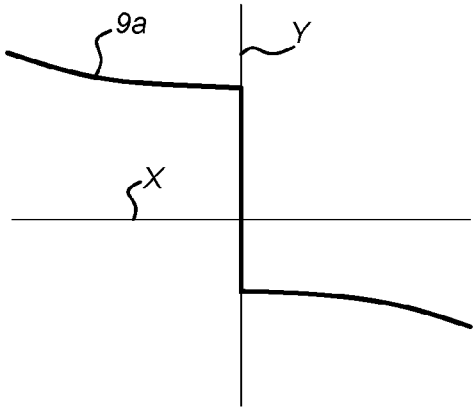
FIGS. 3*a*-3*c* show different characteristics of the spud force versus the spud position obtainable with the spud system according to the invention.

The hydraulic system of FIG. 2*a* will result in characteristics designated 9*a* showing the spud force versus the spud position in FIG. 3*a*. In this figure the spud force is represented by the y-axis and the allowed deviation of the spud out of the neutral position is represented by the x-axis.

Figure 2B:
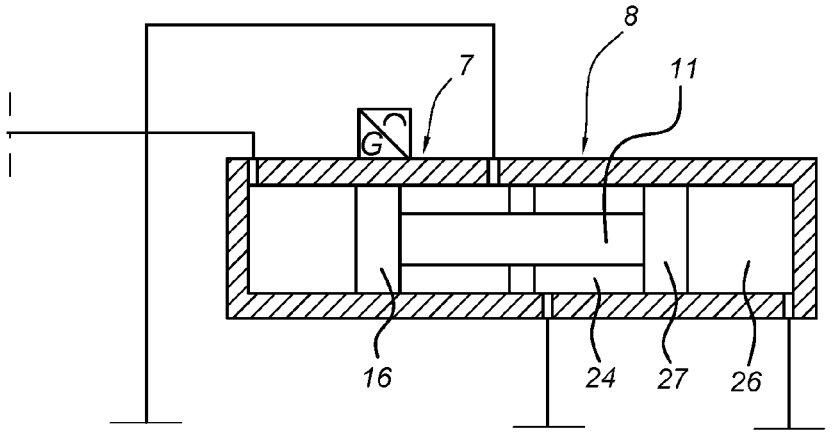
FIG. 2*b*, is a detail of the hydraulic scheme of FIG. 2*a*, wherein an alternative prestressing means is shown.
Figure 3B:
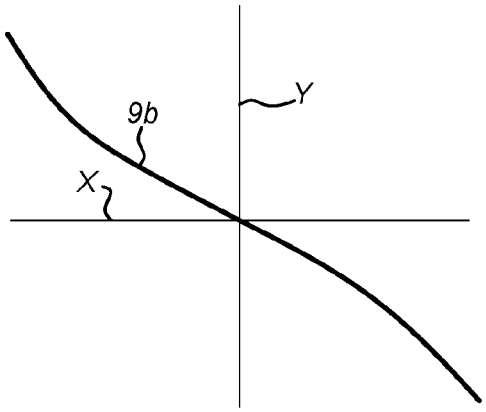

FIG. 2*b* shows a detail of the hydraulic scheme of FIG. 2*a*, wherein an alternative prestressing means 8 is used. In general only differences are described. Compared with the prestressing means in FIG. 2*a*, the free pistons 12, 13 are omitted, as well as the stop 14 of the self centering cylinder housing 35. Therefore, the centering force is exerted through the piston 27. The fluid chambers 24, 26 on both sides of the piston 27 act directly on the piston 27. This will result in characteristics designated 9*b* of the spud force versus the spud position graph shown in FIG. 3*b*. This characteristic 9*b* is also referred to as "spring mode". The characteristics shown can vary depending on the accumulator system and its related settings.

Figure 2C:
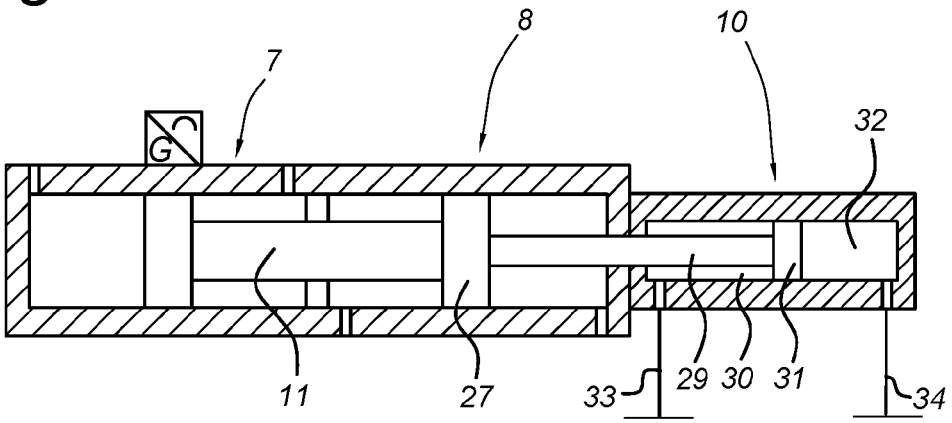
FIG. 2*c* is a detail of an alternative of the hydraulic scheme of FIG. 2*b;*

FIG. 2*c* shows a detail of an alternative of the hydraulic scheme of FIG. 2*b*. In general only differences are described. There is provided a control cylinder 10. The rod 29 of the control cylinder 10 is coupled with the common rod 11 for providing auxiliary control of the position of the centralising force. This provides even better adjustment of the centering force. The control cylinder 10 has a piston 31 and fluid chambers 30, 32 on both sides of the piston 31. The rod 29 is coupled with the common rod 11 through piston 27 of the prestressing means 8. Fluid lines 33, 34 are in fluid connection with corresponding fluid chambers 30, 32 of the control cylinder 10. The fluid lines 33, 34 are in fluid connection with a source of pressurized fluid known per se, which source is suitable to drive the control cylinder 10.

Figure 2D:
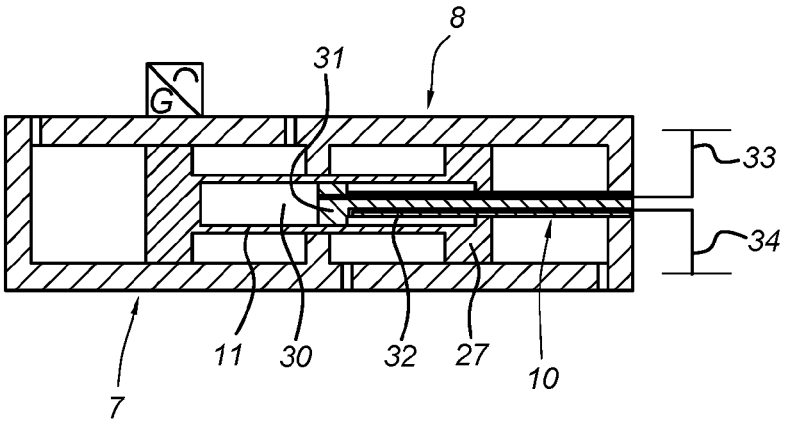
FIG. 2*d* shows a detail of an alternative of the hydraulic scheme of FIG. 2*c*.
Figure 3C:
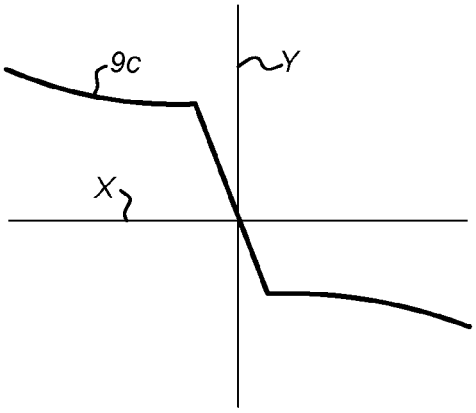

FIG. 2*d* shows a detail of an alternative of the hydraulic scheme of FIG. 2*c* in that the control cylinder 10 is integrated in the common rod 11. The alternative will not be described in detail. Corresponding parts have been numbered accordingly. The alternatives of FIGS. 2*c* and 2*d* will result in characteristics designated 9*c* of the spud force versus the spud position graph shown in FIG. 3*c*.

It will also be obvious after the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. A spud system for a dredging vessel with a longitudinal direction, which spud system comprises;

a spud carrier for mounting a spud therein in a vertical stance and which spud carrier is moveable with respect to the dredging vessel in a longitudinal direction for advancing the dredging vessel, a spud carrier drive system coupled with the dredging vessel and the spud carrier for driving the spud carrier with respect to the dredging vessel, wherein the spud carrier drive system comprises a hydraulic drive cylinder for controlling the position of the spud carrier, and a hydraulic system comprising a parallel hydraulic cylinder in fluid parallel connection with the hydraulic drive cylinder and presstressing means coupled with a rod of the parallel hydraulic cylinder such that said rod is forced towards a central position.

2. The spud system according to claim 1, wherein the presstressing means comprise a self centring cylinder.

3. The spud system according to claim 1, wherein the rod of the hydraulic parallel cylinder is coupled with a rod of the self centring cylinder.

4. The spud system according to claim 1, wherein the rod of the hydraulic parallel cylinder and the rod of the self centring cylinder are of one-piece and form a common rod of the hydraulic parallel cylinder and the self centring cylinder.

5. The spud system according to claim 4, comprising a control cylinder wherein a rod of the control cylinder is coupled with the common rod for providing auxiliary control of the centring force.

6. The spud system according to claim 1, wherein the hydraulic drive cylinder and parallel hydraulic cylinder have a similar configuration with respect to bore and rod diameter for facilitating position control of the spud carrier.

7. The spud system according to claim 2, comprising an accumulator system coupled with the self centring cylinder for providing a desired centring force and a desired spring action for the rod of the self centring cylinder.

8. The spud system according to claim 1, wherein the self centring cylinder comprises a pair of opposite pressurized fluid chambers the rod of the self centring cylinder is provided with a central flange or piston arranged such that the opposite pressurized fluid chambers exert the centring force on the rod of the self centring cylinder.

9. The spud system according to claim 8, wherein the pair of opposite pressurized fluid chambers are in fluid connection with the accumulator system.

10. The spud system according to claim 8, wherein the accumulator system comprises a common source of pressure and the pair of opposite pressurized fluid chambers are in fluid connection with the common source of pressure.

11. The spud system according to claim 7, wherein the accumulator system comprises a number of respective sources of pressure and pressurized fluid chambers are each in fluid connection with a respective source of pressure.

12. The spud system according to claim 7, wherein the accumulator system comprises an accumulator with an adjustable gas pressure in order to be able to adjust the centring force.

13. The spud system according to claim 2, wherein the rod of the self centring cylinder is provided with a free piston and the centring force is exerted through said free piston.

14. The spud system according to claim 2, wherein the rod of the self centring cylinder is provided with a pair of opposite free pistons arranged at opposite sides of the central flange and the centring force is exerted through said pair of opposite free pistons.

15. The spud system according to claim 4, wherein a self centring cylinder housing is provided with a stop for defining the central position of the common rod.

16. A dredger comprising the spud system of claim 1.

* * * * *